US006786435B2

(12) United States Patent
Mishra

(10) Patent No.: US 6,786,435 B2
(45) Date of Patent: Sep. 7, 2004

(54) TWIN DISCHARGE CONVEYOR FOR A TRUCK MOUNTED SPREADER SYSTEM

(75) Inventor: Amiya Kumar Mishra, Cambridge (CA)

(73) Assignee: Cives Corporation, Roswell, GA (US)

( * ) Notice: Subject to any disclaimer, the term of this patent is extended or adjusted under 35 U.S.C. 154(b) by 78 days.

(21) Appl. No.: 09/929,505

(22) Filed: Aug. 15, 2001

(65) Prior Publication Data

US 2003/0034406 A1 Feb. 20, 2003

(51) Int. Cl.[7] ..... A01C 19/00

(52) U.S. Cl. ..... 239/677; 239/672; 239/674; 239/675; 239/682; 239/684; 239/687

(58) Field of Search ..... 239/681, 664, 239/665, 666, 655, 672, 674, 675, 650, 687, 673, 677, 684

(56) References Cited

U.S. PATENT DOCUMENTS

| | | | | | |
|---|---|---|---|---|---|
| 1,940,008 | A | | 12/1933 | Mosgrove | |
| 2,060,652 | A | | 11/1936 | Arnold | |
| 2,099,369 | A | | 11/1937 | Lutz | |
| 2,350,476 | A | * | 6/1944 | Richey | 239/664 |
| 2,369,755 | A | * | 2/1945 | Rosselot | 239/664 |
| 3,189,355 | A | | 6/1965 | Swenson et al. | |
| 3,559,893 | A | | 2/1971 | Gruben | |
| 3,583,646 | A | * | 6/1971 | Bogenschutz | 239/666 |
| 3,780,955 | A | * | 12/1973 | Palmer | 239/672 |
| 4,478,369 | A | | 10/1984 | Von Holten | |
| 5,178,333 | A | * | 1/1993 | Barber et al. | 239/655 |
| 5,318,226 | A | | 6/1994 | Kime et al. | |
| 6,092,745 | A | | 7/2000 | Seymour et al. | |

* cited by examiner

*Primary Examiner*—Christopher Kim
(74) *Attorney, Agent, or Firm*—Burns, Doane, Swecker & Mathis, L.L.P.

(57) ABSTRACT

A twin discharge conveyor mounted on a spreader truck is shown including two parallel mounted conveying mechanisms such as augers, belt conveyors and chain conveyors contained within a conveyor trough that is mounted laterally on a truck chassis adjacent the front end of a frame mounted material storage container. The conveying mechanisms are independently controlled by separate hydraulic motors so that material can be discharged to the left and to the right of the truck simultaneously and in varying amounts.

19 Claims, 8 Drawing Sheets

TWIN DISCHARGE CONVEYOR FOR A TRUCK MOUNTED SPREADER SYSTEM

FIELD OF THE INVENTION

The present invention relates to a spreader system mounted on a truck. More particularly the invention pertains to a twin discharge conveyor used to convey material from a truck mounted storage container to a desired application point.

BACKGROUND ON THE INVENTION

Known spreader trucks convey materials, such as salt, sand and or salt/sand mixtures, from a storage container to a desired application point. The storage container mounted on the truck can be in the form of a combination dump box or combination sander body or V-Box hopper spreader. The spreader trucks are used to spread anti-icing and traction material on highways and roadways. It is known to provide a longitudinal conveyor positioned below the storage container and oriented along the axis of the storage container to convey the materials to either the front of the storage container or the rear of the storage container for discharge. If the material is moved along the longitudinal conveyor to be discharged at the front of the truck, the material can be dumped from the longitudinal conveyor onto a cross conveyor which then moves the material either to the left or to the right and thereafter discharges the material onto a spinner. The cross conveyors may be constructed using belting or chains or a screw auger, but in every case the movement of the conveyor is in a singular direction either to the left or to the right of the truck. In the case where a split conveyor is provided, with one conveyor being capable of moving material to the left of the truck and a second conveyor being capable of moving material to the right of the truck, the material is directed evenly to both conveyors, such as by pouring the material over a V-shaped dividing partition that directs half of the material to one conveyor and the other half to the second conveyor, or by shifting the longitudinal conveyor to dump all the material on one or the other of the cross conveyors. When it is desired to only spread material to one side of the truck, only the cross conveyor that moves material to that side of the truck is operated. A problem with the split conveyor system, however, is that an unacceptable amount of material continues to be discharged from the side of the truck where it is not wanted. The undesired leakage of material on the side of the truck where a cross conveyor is not being operated occurs as material continues to be divided evenly to both sides of the truck and the build up of material on the side of the truck where the conveyor is not operating results in continued leakage of material to that side of the truck.

SUMMARY OF THE INVENTION

In view of the above disadvantages of prior art spreader trucks, the present invention is directed to a twin discharge conveyor mounted to the chassis of the truck in front of a frame mounted material storage container, with the twin discharge conveyor being controllable by an operator to discharge material to either the left, the right, or both left and right sides of the equipped vehicle chassis. The twin conveyor can also be mounted at the rear of the frame mounted material storage container when a main longitudinal conveyor for moving material from the storage container to the twin conveyor operates in rear discharge mode. In a preferred embodiment of the invention, the twin discharge conveyor includes two augers mounted parallel to each other in a conveyor trough that is mounted to the chassis of the truck in front of the frame mounted material storage container. The twin cross conveyor can also include two belts or two chains mounted parallel to each other in a rectangular open conveyor box. The function and operation are similar to that of a twin auger conveyor.

The material can be moved along a longitudinal conveyor that is positioned underneath the storage container or can even form an integral bottom of this storage container, and dumped through a gate into the conveyor trough mounted crosswise at the front of the storage container. The two parallel mounted augers can be independently operated, such as by hydraulic motors. The hydraulic motors can be mounted at one end or the other of the augers and can be of various types including vane motors, gear motors or piston motors. In a preferred embodiment the hydraulic motors are gerotor motors, which are internal gear motors that can be driven at different rates of speed depending on the flow rate of hydraulic fluid provided to the motor. By controlling the flow of hydraulic fluid to the motors, the twin discharge conveyor can be operated with only one auger being rotated in a direction to move material to a first side of the vehicle, both augers being rotated in a direction to move material to the first side of the vehicle, only one auger being rotated to move material to a second side of the vehicle, both augers being rotated to move material to the second side of the vehicle, or one auger being rotated to move material to the first side of the vehicle while the second auger is rotated in the opposite direction to move material to the second side of the vehicle. The independent control of the motors operating the augers also allows the rates of speed of the two augers to be controlled independently, such that various ratios of the amounts of material being discharged to the first side and/or the second side of the vehicle can be achieved.

The rate at which material can enter the conveyor trough can be controlled by controlling the opening of a gate, and the rate of speed of the augers can be controlled independently to achieve the desired distribution of material per distance traveled by the spreader truck. Each end of the conveyor trough can also be provided with adjustable chutes and spinners that are adjustable vertically as well as horizontally. The chutes direct the material moved to the sides of the truck by the augers onto the spinners that then distribute the material in a desired pattern. The position of the chutes is adjustable so that material is dumped onto the spinners at different positions to achieve the desired distribution pattern. The spinners can also be rotated out of the way so that material is simply dumped from the discharge chutes onto the roadway to leave furrows of the material along one or both sides of the truck.

A spreader truck having the twin discharge conveyor according to an embodiment of the invention has the capability of accommodating road conditions that require the application of more material to one side of the chassis of the truck than the other. The rate at which the material is discharged from the twin discharge conveyor according to the invention to each side of the vehicle can also be varied. The vehicle operator can therefore regulate the placement of material so that it is applied where it is needed most. The conveyor trough is also designed to conform closely to the configuration of the two parallel augers, so that material placed into the conveyor trough is distributed only where it is desired, and little or no waste of the material occurs.

BRIEF DESCRIPTION OF THE DRAWINGS

A better understanding of the invention will be obtained from the following detailed description and the accompanying drawings, in which.

DETAILED DESCRIPTION OF THE PREFERRED EMBODIMENT

A truck mounted twin discharge conveyor according to an embodiment of the invention is mounted to the chassis of the truck in front, rear or both front and rear of a frame mounted material storage container, such as a combination dump box or combination sander body or V-box hopper spreader. The discharge system according to the invention includes at least two independently operated conveyors housed in a conveyor trough or rectangular open box that receives material through an adjustable gate and then conveys the material to the left and/or right of the chassis for discharge. The material can be discharged to the left of the chassis, to the right of the chassis, or to a combination of both the left and right sides of the chassis at different desired ratios. The material being discharged from the conveyor trough or rectangular open box at the left and/or right sides of the chassis can be directed to different points on spinners to achieve a desired distribution pattern.

Figure 1A:
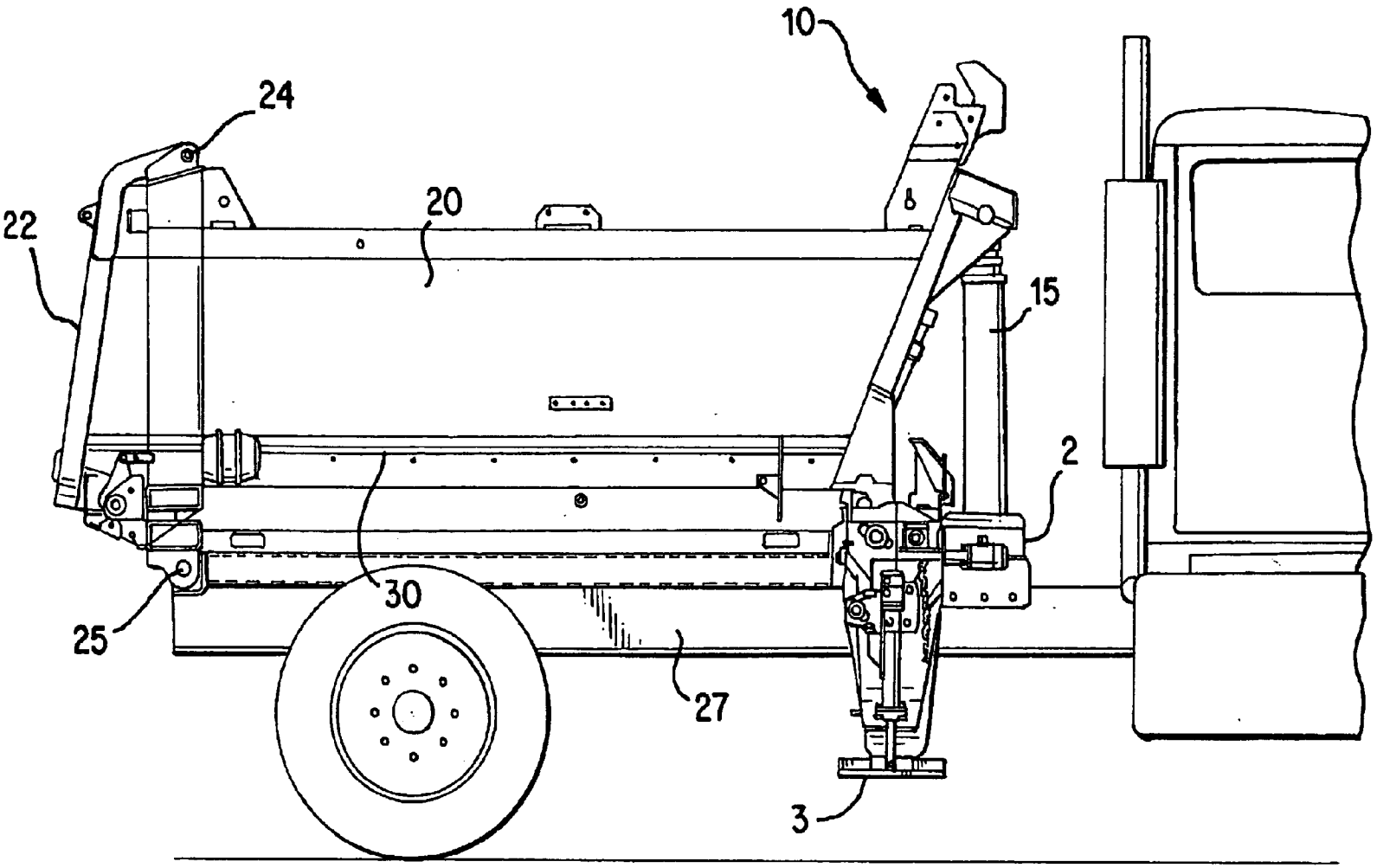
FIG. 1A illustrates a side elevation view of a spreader truck having a twin conveyor discharge system according to an embodiment of the invention.
Figure 1B:
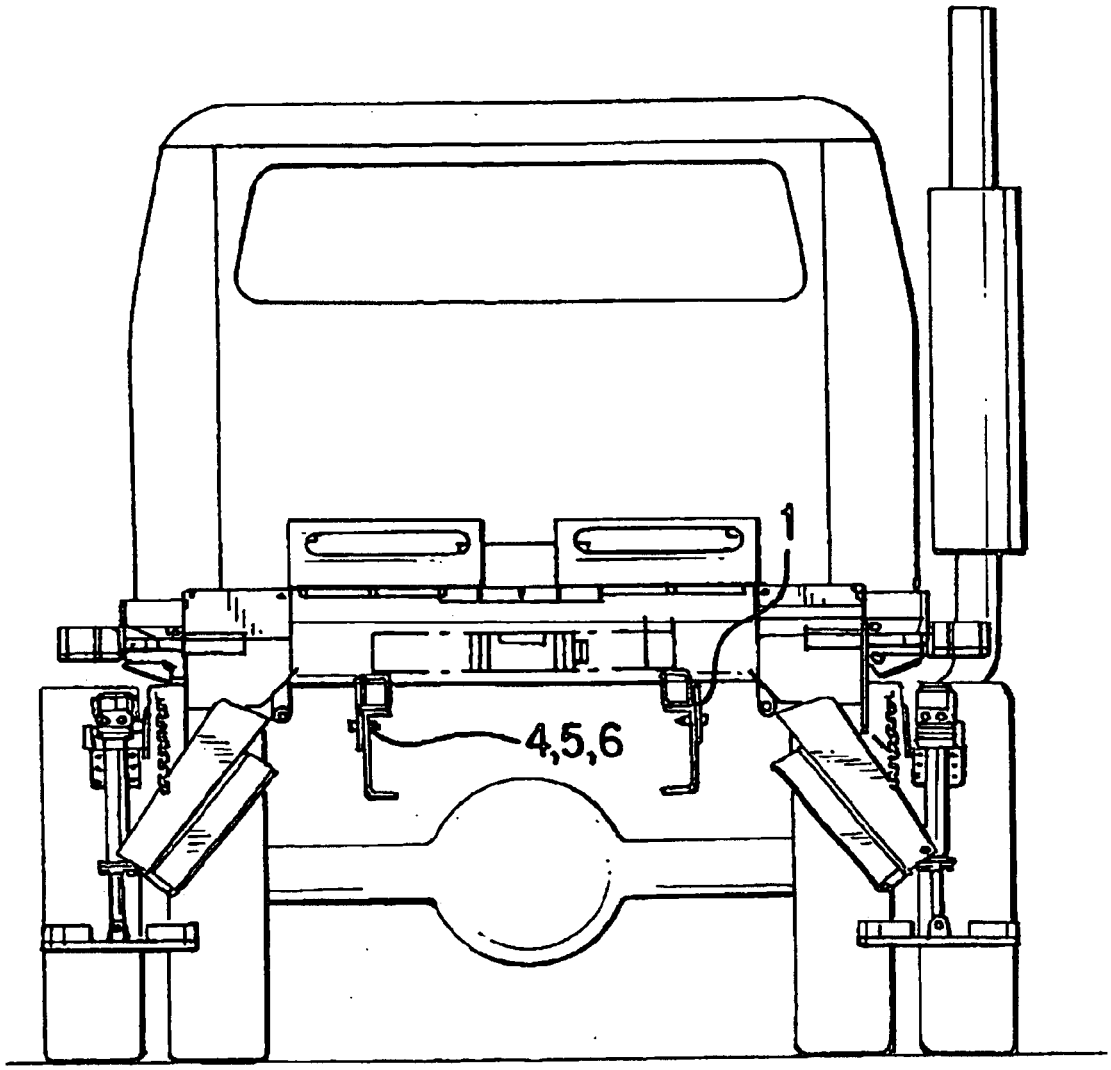
FIG. 1B illustrates a rear elevation view of the spreader truck shown in FIG. 1A.

Referring initially to FIGS. 1A, 1B, a dump truck 10 incorporating a preferred embodiment of the invention has a dump body 20 pivotable about a rear pivot axis 25 between a normal or horizontal position resting on a pair of parallel longitudinal beams or rails 27 of the truck frame and a raised dump position (not shown) when it is desired to empty material stored within the dump body 20 rapidly through pivotal tailgate 22. As the dump body 20 is raised by extending hydraulic piston 15, the tailgate 22 pivots about an axis 24 to allow the material within the dump body 20 to be emptied.

Figures 2, 2A, 2C:
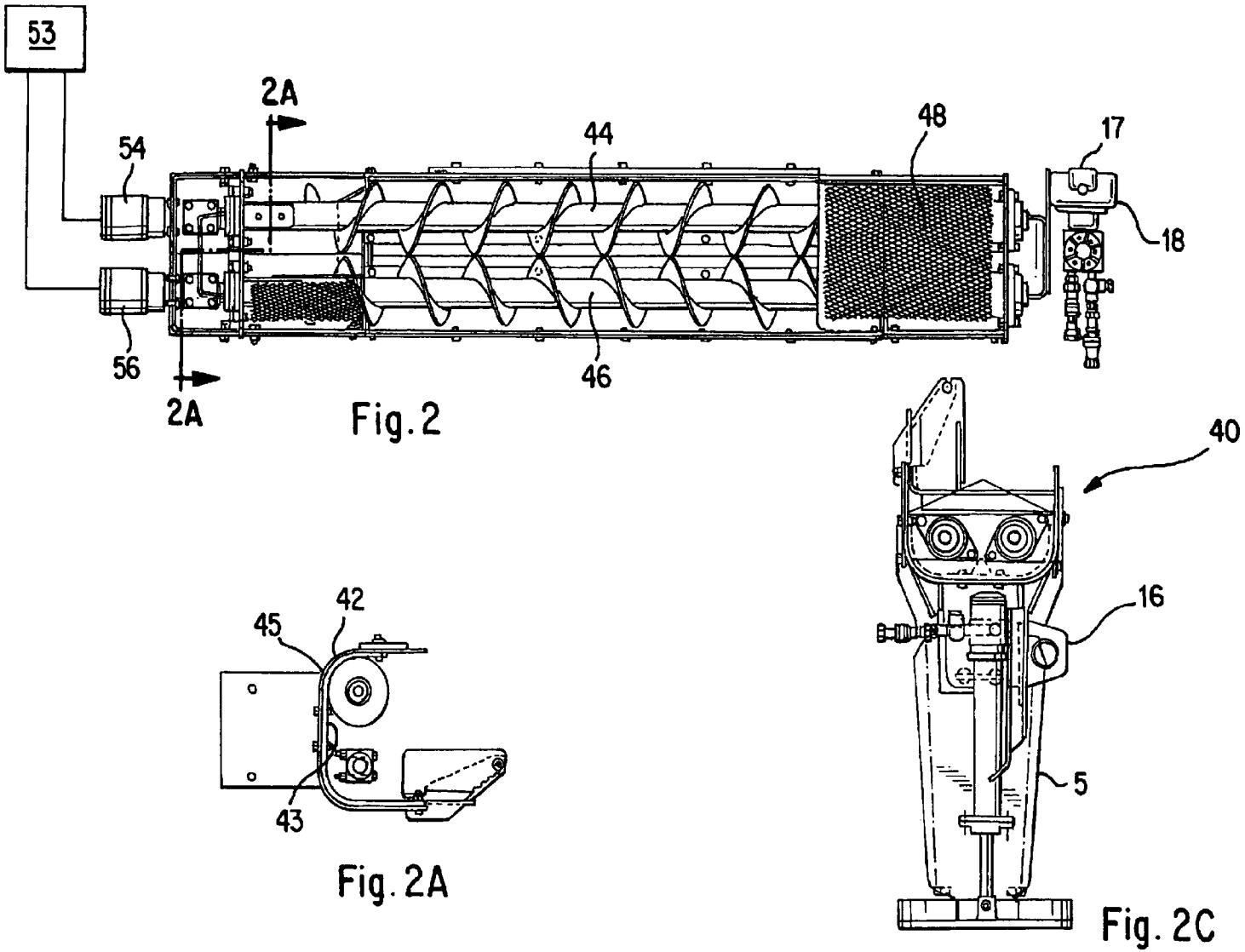
FIG. 2 illustrates a top plan view of the conveyor trough and twin augers according to an embodiment of the invention.
FIG. 2A illustrates a view taken in the direction of arrows A—A in FIG. 2.
FIG. 2C illustrates a side elevation view of the discharge system shown in FIG. 2B.

When in the normal or horizontal position shown in FIG. 1A, material within the dump body 20 can be moved by an integral longitudinal conveyor 30 toward the front end and/or rear end of the truck chassis and into a conveyor trough 42 or open rectangular box, shown in FIG. 2A. The longitudinally extending conveyor 30 can be integrated into the bottom structure of the dump body 20, as described for example in U.S. Pat. No. 4,886,214 to Mouso, Jr. et al., which is incorporated herein by reference.

The conveyor trough 42 is mounted laterally across the truck rails 27 near the front end of the truck chassis. As best seen in FIG. 2A, the conveyor trough 42 has a substantially U-shaped configuration, and houses two parallel augers 44 and 46. The two augers 44, 46 are mounted in close proximity to each other and the conveyor tough 42 is configured to match the outer profiles of the two augers so that all material dumped into the conveyor trough 42 will be efficiently discharged from one end or the other of the trough depending on the direction of rotation of the augers 44, 46. The bottom 45 of conveyor trough 42 can be provided with a central partition 43 that directs all material into the path of one or the other of the augers 44, 46.

Figure 2B:
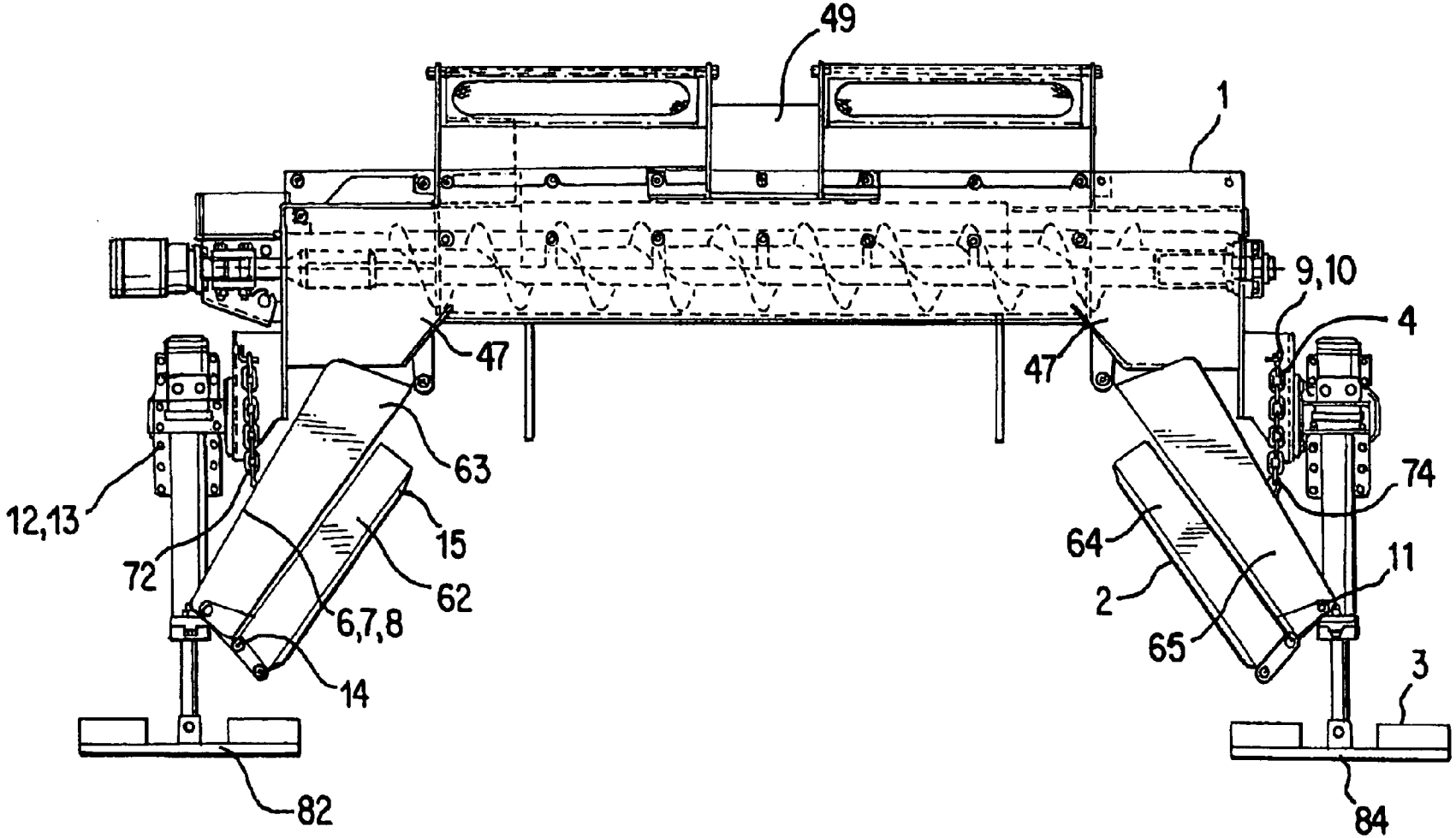
FIG. 2B illustrates an elevation view of the conveyor trough shown in FIG. 2, and showing a pair of discharge chutes leading to a pair of adjustable spinners.

As best seen in FIG. 2B, opposite ends of the conveyor trough 42 terminate in chutes 64, 65 and 62, 63 that direct material from the conveyor trough onto spinners 82 and 84. Side flanges 65 and bottom channel 64 are pivotally connected at one side of the trough 42 and can be positioned at different angles relative to the trough by changing the length of chain 74. Similarly, side flanges 63 and bottom channel 62 form a chute at the other side of the conveyor trough and can also be adjusted to form different angles with the trough by changing the length of a chain 72. Material moved by one or both of the augers 44, 46 is directed down the chutes and onto one or both of the spinners 82, 84. A change in the length of the chains 72, 74 changes the angle at which the chutes 64, 65 and 62, 63 are mounted relative to the conveyor trough 42 and directs material from the conveyor trough to different points on the spinners 82, 84. For example, an increase in the length of chains 72, 74 in FIG. 2B would cause material to fall on the spinners 82, 84 at a point closer to the center of the truck, while shortening the length of chains 72, 74 would cause material being discharged from the chutes to fall at points on spinners 82, 84 that are farther from the center of the truck. The change in location on the spinners 82, 84 at which the material is applied affects the pattern of distribution of the material flung outwardly by the rotating spinners.

Figure 3A:
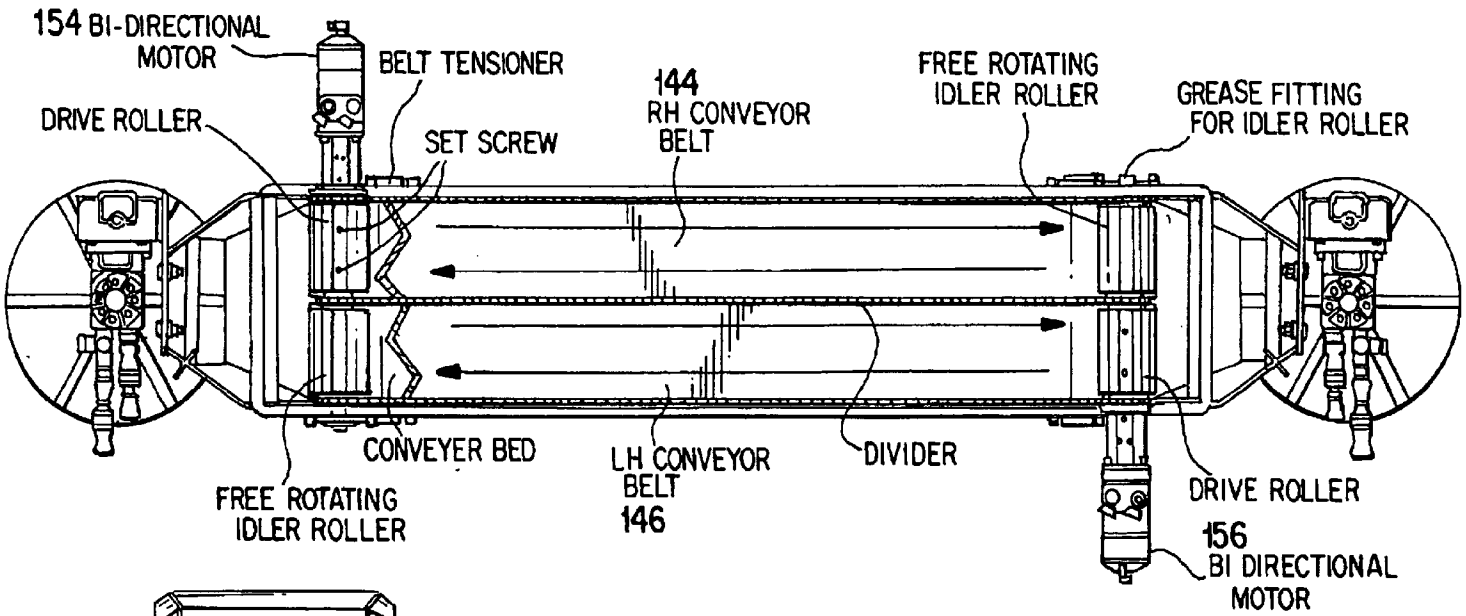
FIG. 3A illustrates a top plan view of an embodiment of the discharge system having twin belt conveyors.
Figure 3C:
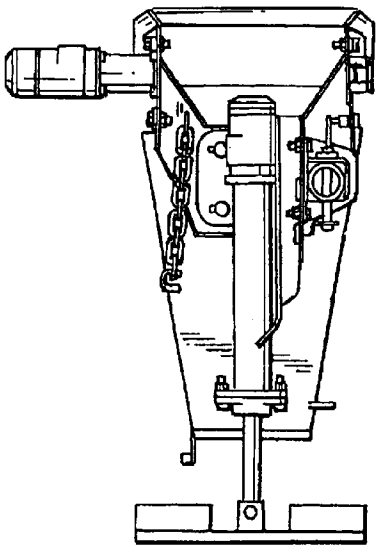
FIG. 3C illustrates an end elevation view of the embodiment shown in FIG. 3A.
Figure 3B:
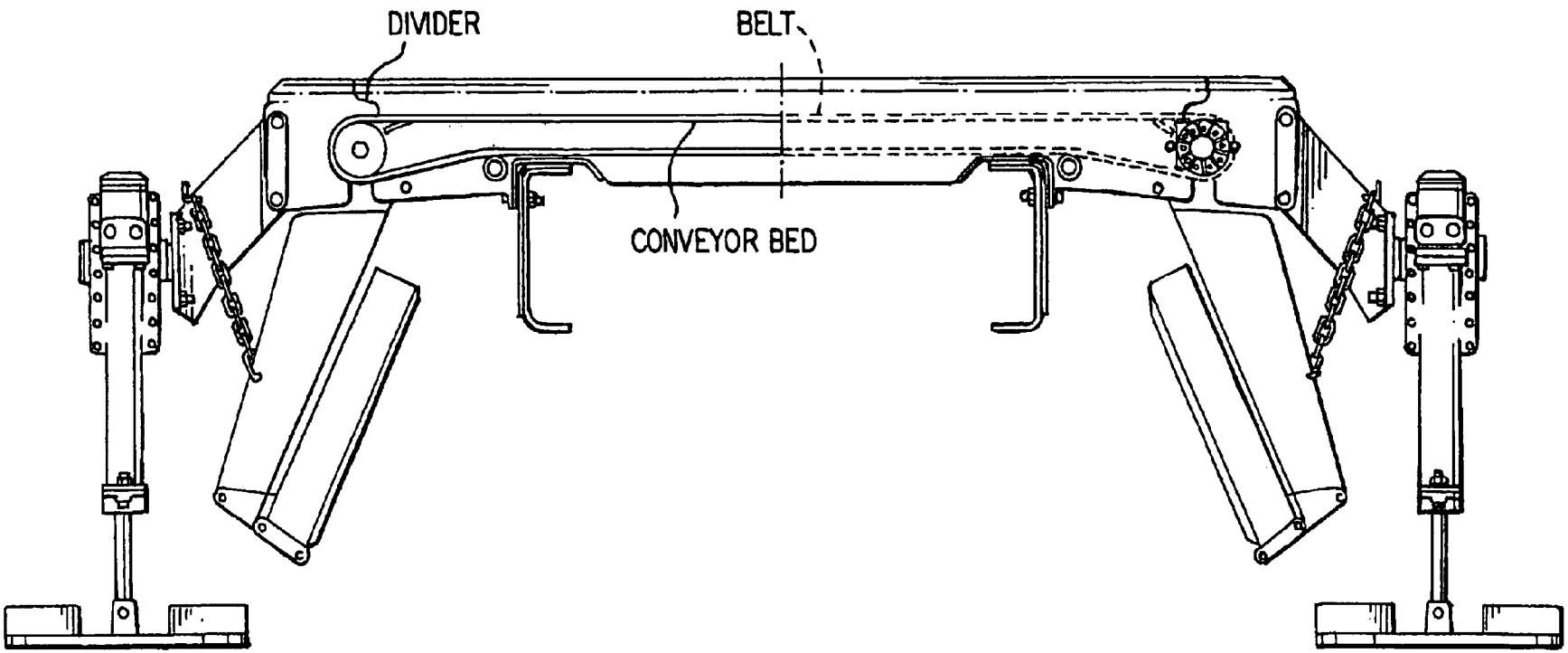
FIG. 3B illustrates a side elevation view of the embodiment shown in FIG. 3A.

In an alternative embodiment of the discharge system, as illustrated in FIGS. 3A–3C, the twin augers 44, 46 can be replaced with twin belt conveyors 144, 146. The belt conveyors 144, 146 can be driven by directional motors 154, 156 to move material at the same or different rates of speed to one side of the truck, the other side of the truck, or both sides of the truck in any desired ratio.

Figure 4A:
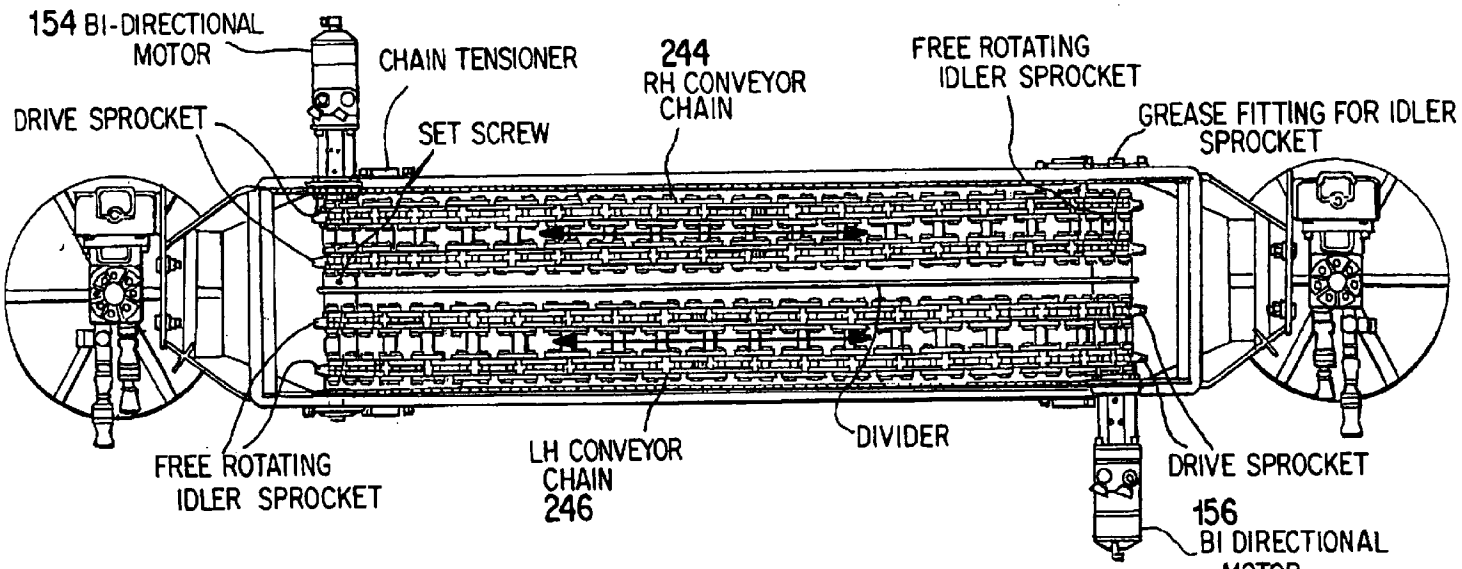
FIG. 4A illustrates a top plan view of an embodiment of the discharge system having twin chain conveyors.
Figure 4C:
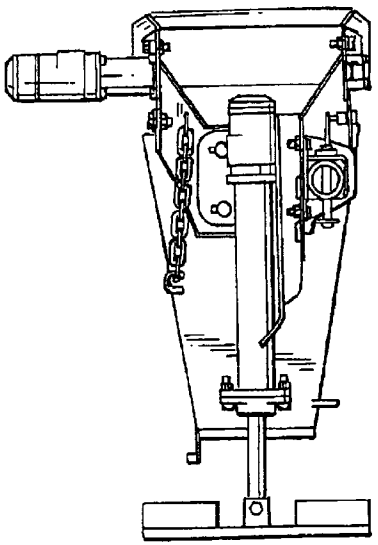
FIG. 4C illustrates an end elevation view of the embodiment shown in FIG. 4A.
Figure 4B:
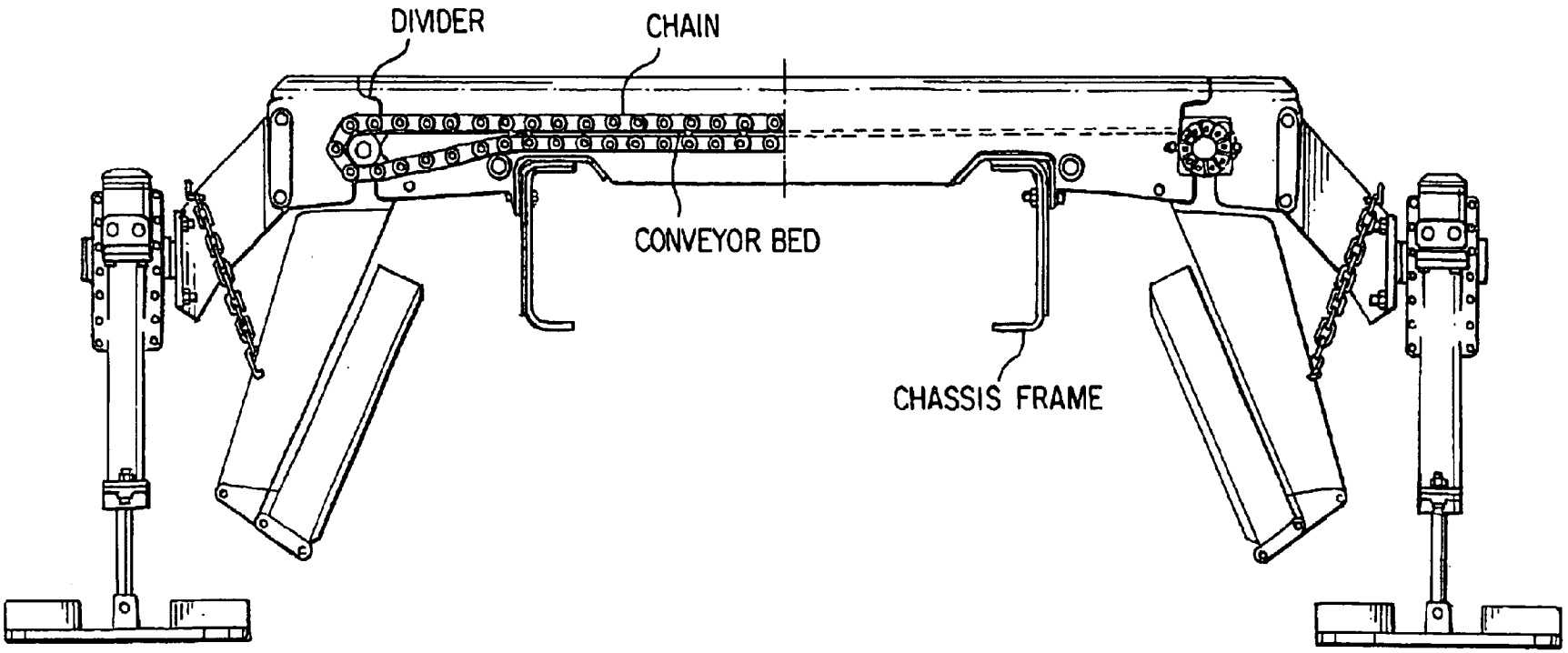
FIG. 4B illustrates a side elevation view of the embodiment shown in FIG. 4A.

Similarly, in another alternative embodiment of the discharge system, as illustrated in FIGS. 4A–4C, twin chain conveyors 244, 246, driven by directional motors 154, 156, move material at the same or different rates of speed to one side of the truck, the other side of the truck, or both sides of the truck in any desired ratio.

A gate 49 can be provided at the top entrance to the conveyor trough 42, and/or incorporated in material storage container 20, to regulate the amount of material allowed to enter the conveyor trough 42 from longitudinal conveyor 30. Adjustment of the opening into the conveyor trough 42 provides one means for controlling the rate at which material is discharged from the spreader truck.

Hydraulic motors 54 and 56 can be mounted at one end of respective augers 44 and 46. Regulation of the amount of hydraulic fluid provided to the hydraulic motors 54 and 56 can be achieved through use of a conventional proportional control valve 53. The hydraulic motors 54 and 56 are preferably reversible and variable speed. A conventional gerotor motor is one example of a hydraulic motor that can be used in an embodiment of the invention. Independent control of the hydraulic motors allows the truck operator to control the rate and direction at which material is discharged from conveyor trough 42. As an example, auger 44 can be rotated in one direction to move material to one side of conveyor trough 42, while auger 46 is rotated in the opposite direction to move material to the opposite side of the conveyor trough 42. The rate of speed at which each auger is rotated, as controlled by proportional control valve 53, controls the proportion of material that is driven to one side or the other of the conveyor trough 42. If it is desired to move all of the material to one side or the other of the conveyor trough, one or both of the augers 44, 46 can be rotated in the same direction.

Spinners 82, 84 can be positioned below the outlets of conveyor chutes 62, 63 and 64, 65. Spinners 82, 84 can be adjustable vertically and horizontally, which in effect controls the pattern of distribution of material. As material is discharged from the conveyor chutes onto the spinners, centrifugal force flings the material out in a desired pattern. If desired, the spinners can also be rotated ninety degrees out of the way of material being discharged from the conveyor chutes so that the material is simply deposited in a mound or furrow along the roadway.

The independent control of twin augers 44, 46 allows an operator to accurately control the amount of material being supplied to one side of the road or the other. The material can be supplied either entirely to one side of the truck chassis or to the other, or can be supplied in any desired ratio to both sides of the truck chassis.

As will be apparent to persons skilled in the art, various modifications, adaptations and variations of the foregoing specific disclosure can be made without departing from the teachings of the present invention. For example, although twin auger style conveyors, twin belt conveyors and twin chain conveyors are shown in the various embodiments of the invention described, alternative conveying means could include various combinations of these conveying mechanisms that are independently controlled within a conveyor trough to direct material to one or both sides of the conveyor trough. Furthermore, although two parallel mounted augers, belt conveyors and chain conveyors are shown, one of ordinary skill in the art will recognize that additional augers, belt conveyors and/or chain conveyors that are independently controlled could be provided.

What is claimed is:

1. A material spreader mounted on a truck having a chassis, said material spreader comprising:

a trough mounted laterally on the chassis of the truck, and at least two conveying mechanisms mounted within said trough, each of said conveying mechanisms being independently driven to rotate in a desired direction and at a desired speed, wherein each of said at least two conveying mechanisms is adapted to be driven in a first direction to convey material to one side of the chassis outboard of the chassis, and in a second direction to convey material to the opposite outboard side of the chassis.

2. The material spreader according to claim 1, wherein:

said conveying mechanisms are each independently driven by a hydraulic motor.

3. The material spreader according to claim 2, wherein:

a first one of said at least two conveying mechanisms is driven to move material in a first direction while a second one of said at least two conveying mechanisms is driven to move material in a second direction opposite to said first direction.

4. The material spreader according to claim 3, wherein:

said first conveying mechanism is driven to move material at a first speed, and said second conveying mechanism is driven to move material at a second speed different than said first speed.

5. The material spreader according to claim 1, wherein at least a first one of said two conveying mechanisms is an auger and is driven to rotate to move material at a first speed, and at least a second one of said at least two conveying mechanisms is driven to move material at a second speed different than said first speed.

6. The material spreader according to claim 5, wherein said first and second conveying mechanisms are each independently driven to move by a hydraulic motor.

7. The material spreader according to claim 1, further including:

at least one spinner positioned to receive material driven from said trough by one or more of said at least two conveying mechanisms and distribute said material in a desired pattern.

8. The material spreader according to claim 7, wherein:

at least one adjustable chute directs material from said trough to a desired point on said at least one spinner.

9. The material spreader according to claim 8, wherein said at least one adjustable chute is adjusted to a desired angle relative to said trough and said at least one spinner by changing a length of chain suspending an end of said at least one adjustable chute.

10. A method of distributing material from a truck mounted material storage container, the truck including a longitudinal conveyor for moving the material to a laterally mounted trough mounted on the chassis of the truck having at least two lateral conveyors, said method comprising:

moving material from said material storage container along said longitudinal conveyor into said trough, and independently controlling the rate of movement of said at least two lateral conveyors to distribute the material to opposite sides of said trough in a desired ratio, wherein each of said at least two lateral conveyors is adapted to be driven in a first direction to convey material to one side of the chassis outboard of the chassis and in a second direction to convey material to the opposite outboard side of the chassis.

11. The method according to claim 10, further including:

dispensing the material from the opposite sides of said trough onto spinners that fling the material outwardly in a desired pattern.

12. The method according to claim 11, wherein the step of dispensing the material onto spinners includes adjusting the position on said spinners at which the material is deposited.

13. The method according to claim 10, wherein a first one of said at least two lateral conveyors is an auger that is rotated in a first direction at a first speed, and a second one of said at least two lateral conveyors is an auger that is rotated in a second direction at a second speed different than the first speed.

14. The method according to claim 10, wherein a first one of said at least two lateral conveyors is a belt conveyor that is moved in a first direction at a first speed, and a second one of said at least two lateral conveyors is a belt conveyor that is moved in a second direction at a second speed different than the first speed.

15. The method according to claim 10, wherein a first one of said at least two lateral conveyors is a chain conveyor that is moved in a first direction at a first speed, and a second one of said at least two lateral conveyors is a chain conveyor that is moved in a second direction at a second speed different than the first speed.

16. The material spreader according to claim 1, wherein a first one of said at least two conveying mechanisms is an auger and is driven to move material in a first direction, and a second one of said at least two conveying mechanisms is an auger and is driven to move material in a second direction different than said first direction.

17. The material spreader according to claim 1, wherein a first one of said at least two conveying mechanisms is a belt conveyor and is driven to move material in a first direction, and a second one of said at least two conveying mechanisms is a belt conveyor and is driven to move material in a second direction different than said first direction.

18. The material spreader according to claim 1, wherein a first one of said at least two conveying mechanisms is a chain conveyor and is driven to move material in a first direction, and a second one of said at least two conveying mechanisms is a chain conveyor and is driven to move material in a second direction different than said first direction.

19. A device for distributing material from a truck having a chassis and a material storage container mounted on the chassis comprising:

means for moving material from said material storage container in a longitudinal direction relative to said material storage container;

means for moving a first portion of said material in a first lateral direction relative to said material storage container and to one side of the chassis outboard of the chassis and depositing said first portion of said material on a first distributing means; and means for moving a second portion of said material in a second lateral direction different from said first lateral direction relative to said material storage container and to the opposite outboard side of the chassis and depositing said second portion of said material on a second distributing means, wherein said means for moving a first portion of said material in a first lateral direction is also adapted to move said first portion of said material in said second lateral direction, and said means for moving a second portion of said material in a second lateral direction is also adapted to move said second portion of said material in said first lateral direction.

* * * * *